United States Patent [19]

Costin

[11] 3,984,240

[45] Oct. 5, 1976

[54] HIGH STRENGTH CORROSION RESISTANT COBALT-BASE SUPERALLOY

[75] Inventor: Darryl J. Costin, Columbus, Ohio

[73] Assignee: Owens-Corning Fiberglas Corporation, Toledo, Ohio

[22] Filed: July 28, 1975

[21] Appl. No.: 599,554

[52] U.S. Cl. ..... 75/171; 65/1; 65/15; 65/374 M; 75/122; 75/134 F; 148/32

[51] Int. Cl.[2] ..... C22C 19/07

[58] Field of Search ..... 75/171, 170, 134 F, 75/122; 148/32, 32.5; 65/1, 15, 374

[56] References Cited

UNITED STATES PATENTS 3,881,918 5/1975 Costin et al. ..... 75/171

*Primary Examiner*—R. Dean

*Attorney, Agent, or Firm*—John W. Overman; Philip R. Cloutier

[57] ABSTRACT

A cobalt-base alloy, particularly suitable for high temperature molten glass environments, and articles manufactured from the alloy, preferably by casting, are disclosed.

10 Claims, 2 Drawing Figures

HIGH STRENGTH CORROSION RESISTANT COBALT-BASE SUPERALLOY

Figure 1:
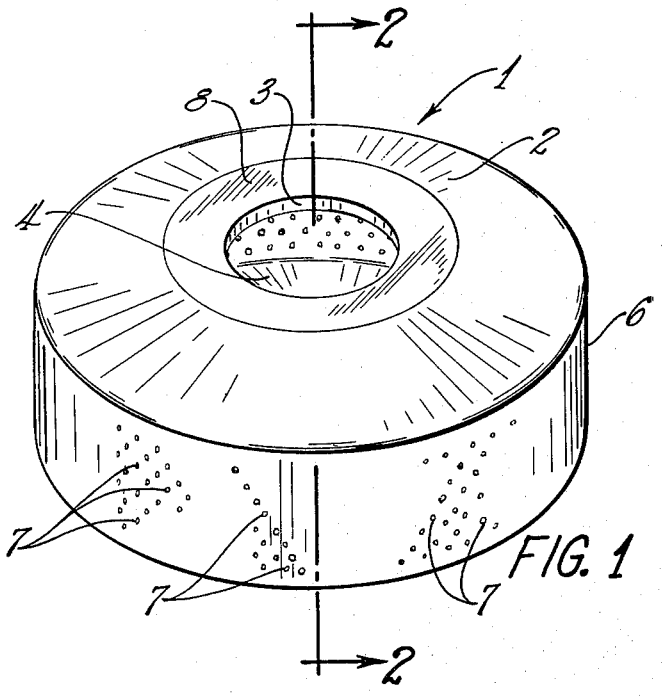

This invention relates to cobalt-base alloys particularly suitable for high temperature glass environments.

In one of its more specific aspects, the invention relates to articles manufactured from the alloys, particularly articles made by casting.

In certain industrial applications, there is a need for alloys which possess high rupture strength and high oxidation resistance at high temperatures. Among such applications are those involved, for example, in the glass fiber industry, where filaments are produced by passing a molten material, for example, glass, through the foraminous walls of a chamber adapted for rotation at high speeds, the chamber being known as a spinner, the filaments being emitted through the apertures of the wall due to the centrifugal action to which the molten material is subjected upon rotation of the spinner. Such spinners are usually operated when spinning glass fibers at temperatures of about 2050°F and rotational speeds of about 1700 RPM. Under these conditions, the alloy of this invention has been found to possess superior stress-rupture and creep properties and superior resistance to the molten glass environment to which it is subjected.

Accordingly, it is the object of this invention to provide a cobalt-base alloy having superior stress-rupture and creep properties, an alloy which can be vacuum melted and cast and which is particularly resistant to corrosion by molten glass.

According to this invention there is provided a composition of matter possessing the following approximate composition, the various components of this composition being expressed herein on a weight percent basis:

| Element | Approximate Composition, Weight % |
|---|---|
| Chromium | About 32 to about 39 |
| Nickel | About 5 to about 17 |
| Wolfram | About 7 to about 13 |
| Tantalum | About 3.2 to about 7.5 |
| Silicon | About 0.5 to about 2.8 |
| Carbon | About 0.2 to about 0.65 |
| Iron | About 0.01 to about 5.5 |
| Yttrium | About 0.05 to about 0.75 |
| Cobalt | Balance |

In the above composition, the weight ratio of wolfram to tantalum will be within the range of from about 1.2 to about 4 and the wolfram plus tantalum content will be not less than about 12.5 weight percent of the total composition.

The preferred composition of this invention will be approximately as follows, on a weight percent basis:

| Element | Approximate Composition, Weight % |
|---|---|
| Chromium | About 33.5 to about 36 |
| Nickel | About 9.5 to about 13 |
| Wolfram | About 9 to about 10.5 |
| Tantalum | About 4 to about 6.2 |
| Silicon | About 1.5 to about 2.3 |
| Carbon | About 0.25 to about 0.35 |
| Iron | About 0.4 to about 0.6 |
| Yttrium | About 0.35 to about 0.55 |
| Cobalt | Balance |

In the preferred composition, the weight ratio of wolfram to tantalum will be within the range of from about 1.7 to about 2.5 and the wolfram plus tantalum content will be not less than about 13.5 weight percent of the total composition.

The best mode of practicing the invention is represented by the following approximate composition on a weight percent basis:

| Element | Approximate Composition, Weight % |
|---|---|
| Chromium | About 35 |
| Nickel | About 10 |
| Wolfram | About 10 |
| Tantalum | About 4.7 |
| Silicon | About 2.3 |
| Carbon | About 0.3 |
| Iron | About 0.5 |
| Yttrium | About 0.45 |
| Cobalt | Balance |

In the above composition, the weight ratio of wolfram to tantalum will be about 2.1 and the wolfram plus tantalum content will be about 14.7 weight percent of the total composition.

The above compositions are not meant to preclude the presence of impurities which are inherently contained in the principal components previously set forth. However, these impurities should be limited to about 0.1 weight percent aluminum, about 0.1 weight percent titanium, about 0.015 weight percent sulfur and about 0.015 weight percent phosphorous.

The compositions of this invention can be prepared by vacuum melting and vacuum casting according to recognized melt procedures for cobalt-base alloys, sometimes known as superalloys. Preferably, the melt components are used in the form of master alloys to facilitate the melting of the high melting point elements such as wolfram, tantalum, chromium and carbon.

In the preferred method of producing the alloy, the original melt formed in the crucible will consist principally of chromium and cobalt. Thereafter, the remainder of the elements required can be introduced into the original melt in any order when the melt temperature is within the range of from about 2700°F to about 2800°F. As an alternate, however, all components of the composition can be introduced into the crucible with the cobalt and chromium. After the addition of these latter materials, the melt is heated to a temperature within the range of from about 2850°F to about 3110°F under a pressure of about 10 microns mercury to produce a uniform composition at which temperature the melt is poured. The resulting castings can be welded and machined by conventional techniques. Preferably, the cast alloy will be heat treated at 1900°F for 3 hours and then air cooled prior to further operations.

The following examples and comparisons illustrate the properties of the alloys of this invention. In all instances, comparison is made between a typical alloy of this invention and "Alloy A," a nickel-based superalloy which is the standard spinner production alloy used in spinner operations, not within the scope of this invention and having the following compositions:

| Element | Approximate Composition, Weight % |
|---|---|
| Chromium | About 35 |
| Molybdenum | About 3.0 |

-continued

| Element | Approximate Composition, Weight % |
|---|---|
| Carbon | About 0.25 |
| Tungsten | About 3.0 |
| Tantalum | About 1.0 |
| Silicon | About 1.2 |
| Iron | About 4.5 |
| Manganese | About 0.25 |
| Nickel | Balance |

This alloy is claimed in U.S. Pat. No. 3,318,694 issued May 9, 1967 to Heitmann.

The typical cast alloy of this invention, produced according to the preferred method outlined above, had the following composition:

| Element | Approximate Composition, Weight % |
|---|---|
| Chromium | 34.8 |
| Nickel | 9.5 |
| Wolfram | 10.1 |
| Tantalum | 5.1 |
| Silicon | 2.0 |
| Carbon | 0.32 |
| Iron | 0.55 |
| Yttrium | 0.43 |
| Cobalt | Balance |
| Wolfram/ Tantalum | 1.98 |
| Wolfram plus Tantalum | 15.2 |

Stress rupture property comparisons between Alloy A and the typical alloy of this invention, both vacuum cast and heat treated, are as follow:

| Alloy | Stress Level, psi | Temperature, °F | Life Time, Hrs. |
|---|---|---|---|
| A | 1500 | 2050 | 110 |
| Invention | 1500 | 2050 | 600 |
| A | 1500 | 2100 | 40 |
| Invention | 1500 | 2100 | 225 |
| A | 1500 | 2055 | 100 |
| Invention | 1500 | 2140 | 100 |

Glass corrosion comparisons between Alloy A, vacuum cast and heat treated, and the typical alloy of this invention, vacuum cast and heat treated, both alloys being partially immersed in the same molten glass at 2170°F for a period of 40 hours were as follows:

| Alloy | Depth of attack, mils | |
|---|---|---|
| | Below Glass | At Airline |
| A | 5.0 | 17.3 |
| Invention | 1.95 | 14.5 |

Generally, a typical alloy of this invention will have an "as cast" hardness of 43.7, Rockwell C Scale, and a "heat treated" hardness of 47.0, Rockwell C Scale.

As previously indicated, alloys of this invention are particularly suited for use in the manufacture of spinners. A combination of stress rupture and metal corrosion by molten glass limits the service life of spinners in operation.

Figure 2:
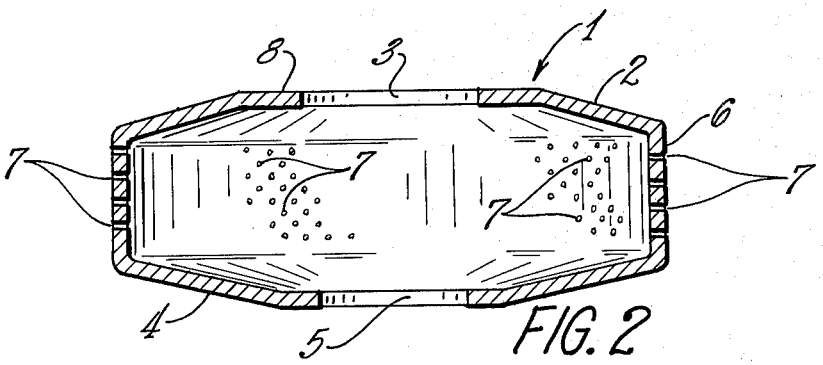

One of the many types of cast spinners which can be fabricated employing the alloy of this invention is illustrated in the attached drawings in which FIG. 1 is a perspective view of the spinner and FIG. 2 is a sectional view of the spinner through section 2—2 of FIG. 1.

Referring now to these figures, in which like numerals represent like parts, there is shown spinner 1 fabricated in its entirety of the alloy of this invention.

Spinner 1 is comprised of an upper wall 2 having opening 3 therein and lower wall 4 having opening 5 therein. Continuous peripheral side wall 6 extends between upper wall 2 and lower wall 4 to form a substantially circular chamber. Side wall 6 is adapted with apertures 7 which penetrate the side wall and through which molten glass, introduced into the spinner through opening 3, is discharged.

As may apply in some spinner types, opening 3 can be adapted with flange 8 for connection to means, not shown, for rotating the spinner. The spinner can also be adapted with opening 5 for the extension therethrough of fluid introductory means, not shown.

It will be evident from the foregoing that various modifications can be made to this invention. Such, however, are considered within the scope of the invention.

What is claimed is:

1. A composition of matter consisting essentially of the following elements in amounts expressed in weight percent:

Chromium — from about 32 to about 39
Nickel — from about 5 to about 17
Wolfram — from about 7 to about 13
Tantalum — from about 3.2 to about 7.5
Silicon — from about 0.5 to about 2.8
Carbon — from about 0.2 to about 0.65
Iron — from about 0.01 to about 5.5
Yttrium — from about 0.05 to about 0.75
Cobalt — balance the weight ratio of wolfram to tantalum being within the range of from about 1.2 to about 4 and the wolfram plus tantalum content being not less than about 12.5 weight percent of said composition.

2. The composition of claim 1 in which said elements are contained in the following approximate amounts, expressed in weight percent:

Chromium — from about 33.5 to about 36.0
Nickel — from about 9.5 to about 13
Wolfram — from about 9 to about 10.5
Tantalum — from about 4 to about 6.2
Silicon — from about 1.5 to about 2.3
Carbon — from about 0.25 to about 0.35
Iron — from about 0.4 to about 0.6
Yttrium — from about 0.35 to about 0.55
Cobalt — balance the weight ratio of wolfram to tantalum being within the range of from about 1.7 to about 2.5 and the wolfram plus tantalum content being not less than about 13.5 weight percent of said composition.

3. The composition of claim 1 in which said elements are contained in the following approximate amounts expressed in weight percent:

Chromium — about 35
Nickel — about 10
Wolfram — about 10
Tantalum — about 4.7

Silicon — about 2.3
Carbon — about 0.3
Iron — about 0.5
Yttrium — about 0.45
Cobalt — balance the weight ratio of wolfram to tantalum being about 2.1 and the wolfram plus tantalum content being about 14.7 weight percent of the total composition.

4. The composition of claim 1 in which said composition contains up to about 0.1 weight percent aluminum, about 0.1 weight percent titanium, about 0.015 weight percent sulfur and about 0.015 weight percent phosphorous.

5. The composition of claim 1 which is vacuum castable at a temperature within the range of from about 2850°F to about 3110°F.

6. The composition of claim 1 having a life of about 600 hours at stress-rupture conditions of about 1500 psi and 2050°F.

7. The composition of claim 1 having an as cast hardness of 43.7 (Rockwell C Scale) and a heat treated hardness of 47.0 (Rockwell C Scale).

8. An article of manufacture produced by casting the composition of matter defined in claim 1.

9. An article of manufacture produced by casting and machining the composition of matter defined in claim 1.

10. A spinner comprised of the composition of claim 1, said spinner being comprised of foraminous walls and adapted for rotation.

* * * * *